US007379038B2

(12) United States Patent
Lim

(10) Patent No.: US 7,379,038 B2
(45) Date of Patent: May 27, 2008

(54) DRIVING CIRCUIT FOR FLAT PANEL DISPLAY

(75) Inventor: Kyoung-Moon Lim, Gyeonggi-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 701 days.

(21) Appl. No.: 10/606,364

(22) Filed: Jun. 26, 2003

(65) Prior Publication Data

US 2004/0119666 A1 Jun. 24, 2004

(30) Foreign Application Priority Data

Dec. 23, 2002 (KR) ..... 10-2002-0082671

(51) Int. Cl.
*G09G 3/30* (2006.01)

(52) U.S. Cl. ..... 345/76; 345/98; 345/100

(58) Field of Classification Search ..... 345/76–100
See application file for complete search history.

(56) References Cited

U.S. PATENT DOCUMENTS

| | | | | |
|---|---|---|---|---|
| 5,079,636 | A * | 1/1992 | Brody | 348/383 |
| 5,842,977 | A * | 12/1998 | Lesho et al. | 600/300 |
| 6,069,451 | A * | 5/2000 | Hush et al. | 315/169.1 |
| 6,285,343 | B1 * | 9/2001 | Brody | 345/1.1 |
| 6,331,844 | B1 * | 12/2001 | Okumura et al. | 345/87 |
| 2001/0048408 | A1 * | 12/2001 | Koyama et al. | 345/76 |

* cited by examiner

*Primary Examiner*—Vijay Shankar
(74) *Attorney, Agent, or Firm*—Birch, Stewart, Kolasch & Birch, LLP

(57) ABSTRACT

A driving circuit for a flat panel display includes a latch unit which is applied a control signal from a shift register to sequentially sample N-bit digital picture signals and to store the picture signals, and simultaneously output the sampled picture signals by a line pass signal; and a voltage to current converting unit distributing an outer reference current to a plurality of paths using a current mirror method, and supplying current of different levels to data lines of the display panel according to logical combinations of the picture signals which are applied from the latch unit.

18 Claims, 4 Drawing Sheets

DRIVING CIRCUIT FOR FLAT PANEL DISPLAY

This application claims the benefit of Korean Application No. P2002-082671 filed on Dec. 23, 2002, which is herein incorporated by reference.

BACKGROUND OF THE INVENTION

1. Field of the Invention

The present invention relates to a driving circuit for a flat panel display, and more particularly, to a driving circuit for a flat panel display for supplying a current of an analog signal corresponding to a size of a digital image signal to data lines of an organic electroluminescence display (OELD)

2. Discussion of the Related Art

Generally, cathode ray tubes (CRTs), which are among the widely used display devices, are typically used as monitors of television sets, measuring instruments and information terminal devices. However, CRTs are not able to be utilized in miniature electronic devices because of their relatively heavy weight and large size.

Therefore, as a substitute for CRTs, various flat display devices, such as, liquid crystal displays (LCDs), plasma display panels (PDPs), field emission displays (FEDs) and electroluminescence display (ELD), for example, have been developed. These flat display devices have the advantages of a relatively small size, light weight and low power consumption.

Among the flat panel display devices, ELDs are display devices which use electroluminescence, a phenomenon in which light is generated when a certain electric field is applied. ELDS can be classified into two categories based on their luminescence material: inorganic ELDs and organic ELDs (OELD).

OELDs are able to generate visible lights including blue lights, for example. Therefore, OELDs can display colors similar to natural colors, and are characterized by relatively high brightness and lower power consumption.

Also, OELDs have a relatively high contrast ratio of self-illumination. They are thus able to be made using ultra-thin displays, and can be fabricated in a relatively simple manner to reduce environmental pollution.

In addition, OELDs have a relatively rapid response time of a few microseconds (μs). Therefore, a moving picture can be realized more easily. There are fewer restrictions to the angle from which the picture can be viewed, and the display is stable at lower temperature.

On the other hand, an active matrix is widely used in a flat panel display. That is, a plurality of pixels are arranged in matrix form in the flat panel display and image information is supplied selectively to respective pixels through a switching device such as thin film transistors (TFTs) disposed on respective pixels.

In recent years, considerable research has been carried out on thin film transistors which use poly-crystalline silicon material. A driving unit built-in type panel has been developed which is able to improve the picture quality and reduce fabrication cost by being formed in the driving circuit in the panel of the flat panel display.

However, it is difficult to realize a driving circuit which is built in the panel because the image quality is lowered and the yield decreases rapidly due to the unevenness of the poly-crystalline silicon TFT.

The OELD of an active matrix according to a conventional current driving method will be described in detail with reference to accompanying Figures.

FIG. 1 is an exemplary view showing a rough structure of a general active matrix type OELD.

As shown in FIG. 1, an OELD panel 40 includes gate lines GL1 to GLm which cross data lines DL1 to DLn on a glass substrate 1. Pixels 10 are formed independently in square areas defined by the intersections of the gate lines GL1 to GLm and the data lines DL1 to DLn.

The pixels 10 are driven by scan signals applied through the gate lines GL1 to GLm in a gate line unit to generate light corresponding to the size of picture signals applied through the data lines DL1 to DLn.

On the OELD panel 40, a gate driving unit 20 applies a scan signal to the gate lines GL1 to GLm, and a data driving unit 30 supplies a picture signal to the data lines DL1 to DLn. The gate driving unit 20 and the data driving unit 30 are fabricated on an additional single-crystalline silicon substrate and attached on the glass substrate 1 of the panel 40 using a tape carrier package (TCP) method.

FIG. 2 shows an inner block structure of the data driving unit 30 in FIG. 1.

As shown in FIG. 2, the data driving unit 30 includes a first latch 32 which receives a control signal CS1 from a shift register 31 and sequentially samples N-bit digital picture signals DIGITAL [R, G, B] and stores the signals. A second latch 33 receives the picture signals DIGITAL [R, G, B] sampled by the first latch 32 and simultaneously transmits the picture signals DIGITAL [R, G, B] by a line pass signal LP. A voltage to current converting unit 34 converts the picture signals DIGITAL [R, G, B] transmitted from the second latch 33 into analog current values and supplies the picture signals DIGITAL [R, G, B] to the data lines DL1 to DLn of the OELD panel 40.

That is, the first latch 32 sequentially samples the picture signals DIGITAL [R, G, B] and stores the picture signals DIGITAL [R, G, B] in accordance with the control signal CS1 of the shift register 31. The second latch 33 simultaneously supplies the picture signals DIGITAL [R, G, B] stored in the first latch 32 to the voltage to current converting unit 34 in accordance with the line pass signal LP.

The voltage to current converting unit 34 converts the picture signals DIGITAL [R, G, B] into the analog current values and supplies the picture signals DIGITAL [R, G, B] to the data lines DL1 to DLn of the OELD panel 40.

If the voltage to current converting unit 34 is formed using a TFT of poly-crystalline silicon, the voltage to current converting unit 34 can be formed directly on the glass substrate 1 of the OELD panel 40.

However, in order for the voltage to current converting unit 34 to convert the picture signals DIGITAL [R, G, B] from a voltage value to an analog current value, a device such as an operational amplifier (OP-AMP) or a resistant-array besides the poly-crystalline silicon TFT should be applied. In this case, the voltage to current converting unit 34 can not be formed on the glass substrate 1, but is formed on an additional single-crystalline silicon substrate with other components of the data driving unit 30 and attached on the glass substrate 1 using the TCP method.

Most of the components of the data driving unit 30, except for the voltage to current converting unit 34, can be formed in the glass substrate 1 of the OELD panel 40 to reduce the number of integrated circuits required in the data driving unit 30. However, as described above, the data driving unit 30 of the conventional current driving method needs to be formed on an additional single-crystalline silicon substrate and attached on the glass substrate 1 of the OELD panel 40 using the TCP method. This entails a high cost of fabrication. In addition, since an additional attaching process is required, the fabrication of the OELD becomes more complex.

SUMMARY OF THE INVENTION

Accordingly, the present invention is directed to a driving circuit for a flat panel display that substantially obviates one or more problems due to the limitations and disadvantages of the related art.

An object of the present invention is to provide a driving circuit of a flat panel display which is able to form an entire data driving unit on an ELD panel and to minimize power consumption.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object of the present invention, as embodied and broadly described herein, there is provided a driving circuit for a flat panel display including a latch unit which is applied a control signal from a shift register to sequentially sample N-bit digital picture signals and to store the picture signals, and simultaneously output the sampled picture signals by a line pass signal; and a voltage to current converting unit distributing an outer reference current to a plurality of paths using a current mirror method, and supplying current of different levels to data lines of the display panel according to logical combinations of the picture signals which are applied from the latch unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings.

Figure 1:
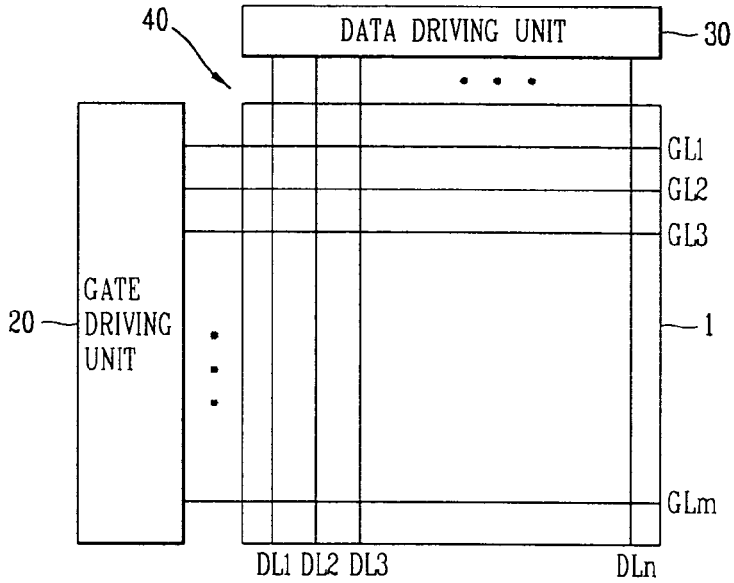
FIG. 1 RELATED ART
FIG. 1 is an exemplary view showing a rough structure of a general active matrix type organic electroluminescence display.
Figure 2:
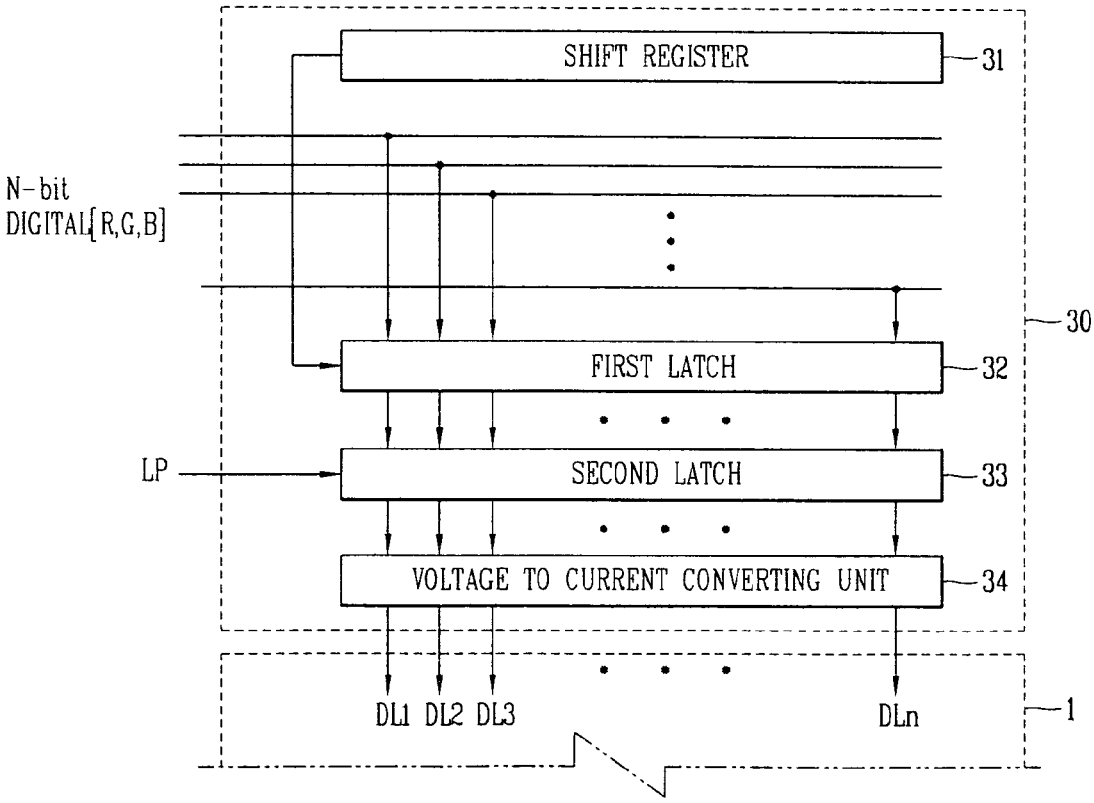
FIG. 2 RELATED ART
FIG. 2 is an exemplary view showing an inner block configuration of a data driving unit shown in FIG. 1.
Figure 3:
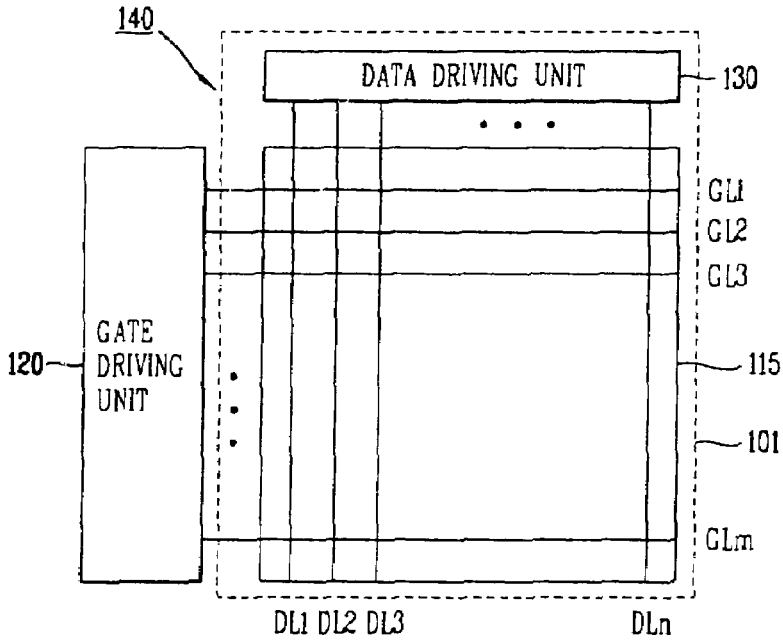
FIG. 3 is an exemplary view illustrating a first embodiment in which a driving circuit of a flat panel display according to the present invention is applied to an OELD.

FIG. 3 is an exemplary view showing a first embodiment of a driving circuit that is applied to an OELD according to the present invention.

As shown in FIG. 3, an OELD panel 140 includes a picture display unit 115 formed on a transparent insulating substrate 101 which may be formed of glass, for example.

On the picture display unit 115, a plurality of gate lines GL11 to GL1*m* are arranged in a transverse direction spaced apart from one another. A plurality of data lines DL11 to DL1*n* are arranged on the picture display unit 115 in a longitudinal direction spaced apart from one another and crossing the gate lines GL11 to GL1*m*. Pixels 110 are electrically connected to the gate lines GL11 to GL1*m*. Data lines DL11 to DL1*n* are independently disposed in areas defined by the intersections of the gate lines GL11 to GL1*m* and the data lines DL11 to DL1*n*.

The pixels 110 are driven by scan signals applied to the gate lines GL11 to GL1*m* in a gate line unit to generate light corresponding to the sizes of picture signals which are applied through the data lines DL11 to DL1*n*.

A gate driving unit 120 applies the scan signal to the gate lines GL11 to GL1*m* and a data driving unit 130 supplies the picture signal to the data lines DL11 to DL1*n*. The gate driving unit 120 and the data driving unit 130 are disposed on the OELD panel 140.

The gate driving unit 120 is disposed on either the left side or the right side of the OELD panel 140 to apply the scan signal to the gate lines GL11 to GL1*m*. The gate driving unit 120 may be attached onto the OELD panel 140 using the TCP method, or the gate driving unit 120 may be built in the insulating substrate 101.

The data driving unit 130 is formed in either an upper part or a lower part of the picture display unit 115 of the insulating substrate 101.

Figure 4:
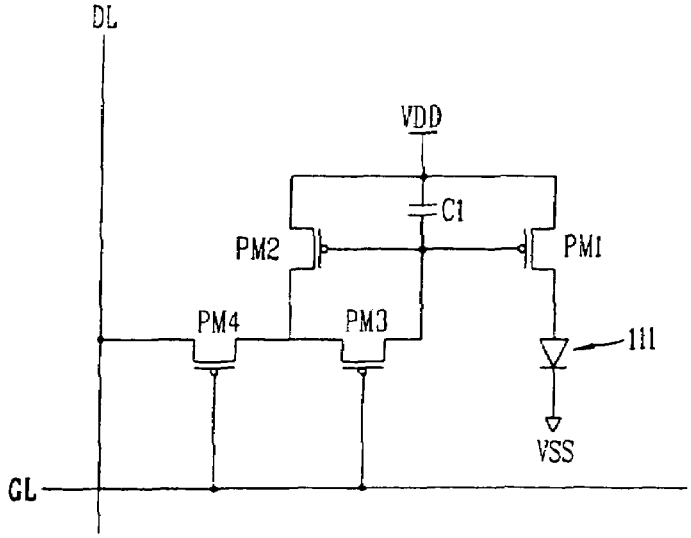
FIG. 4 is an exemplary view showing an equivalent circuit for a unit circuit of a picture display unit in FIG. 3.

FIG. 4 is an exemplary view showing an equivalent circuit for the unit pixel 110 of the picture display unit 115.

As shown in FIG. 4, the circuit includes a first PMOS transistor PM1 and a second PMOS transistor PM2 of which source electrodes are respectively connected to a source voltage VDD and gate electrodes are commonly connected to each other. A first capacitor C1 is connected between the source voltage VDD and a gate electrode contact node of the first and second PMOS transistors PM1 and PM2. An organic electroluminescence device 111 is connected between a drain electrode of the first PMOS transistor PM1 and ground VSS. A third PMOS transistor PM3 is connected between the gate electrode contact node of the first and second PMOS transistors PM1 and PM2, and its conduction is controlled by connecting a gate electrode thereof to a gate line GL. A fourth PMOS transistor PM4 is connected between a drain electrode contact node of the second and the third PMOS transistors PM2 and PM3 and the data line DL, and its conduction is controlled by connecting a gate electrode thereof to the gate line GL.

The operation of the equivalent circuit constructed as above is described as follows.

First, when the scan signal of a low voltage is applied to the gate line GL, the third and fourth PMOS transistors PM3 and PM4 are turned on.

When the third and fourth PMOS transistors PM3 and PM4 are turned on, a constant current flows through a first path that continues to the source voltage (VDD), the second and fourth PMOS transistors PM2 and PM4, and the data line DL by the current value according to the sizes of picture signals inputted from the data line DL.

The current value flowing through the first path also flows on a second path which continues to the source voltage (VDD), the first PMOS transistor PM1, the electroluminescence device 111 and to ground (VSS) by the current mirror principle.

Therefore, the light radiated from the electroluminescence device 111 is controlled by the current value of the data line DL.

Also, a constant voltage value corresponding to the current value flowing through the first path is charged in the first capacitor C1, which is connected between the source voltage (VDD) and the gate contact node of the first and second PMOS transistors PM1 and PM2.

The voltage value charged in the first capacitor C1 maintains the light radiated from the electroluminescence device 111 when the gate lines GL are selected from the first line to the last line of the picture display unit.

That is, the gate lines GL are selected sequentially from the first line to the last line of the picture display unit on which the electroluminescence devices 111 are disposed in a matrix form to display the image of one frame on the picture display unit.

Therefore, when the display of the first gate line GL is completed, the third and fourth PMOS transistors PM3 and PM4 of the first gate line GL are blocked. Then, the next lines to the last line are selected sequentially to display the picture. At that time, the current according to the voltage value charged in the first capacitor C1 is supplied to the electroluminescence device 111 through the second path to maintain the radiated light.

Figure 5:
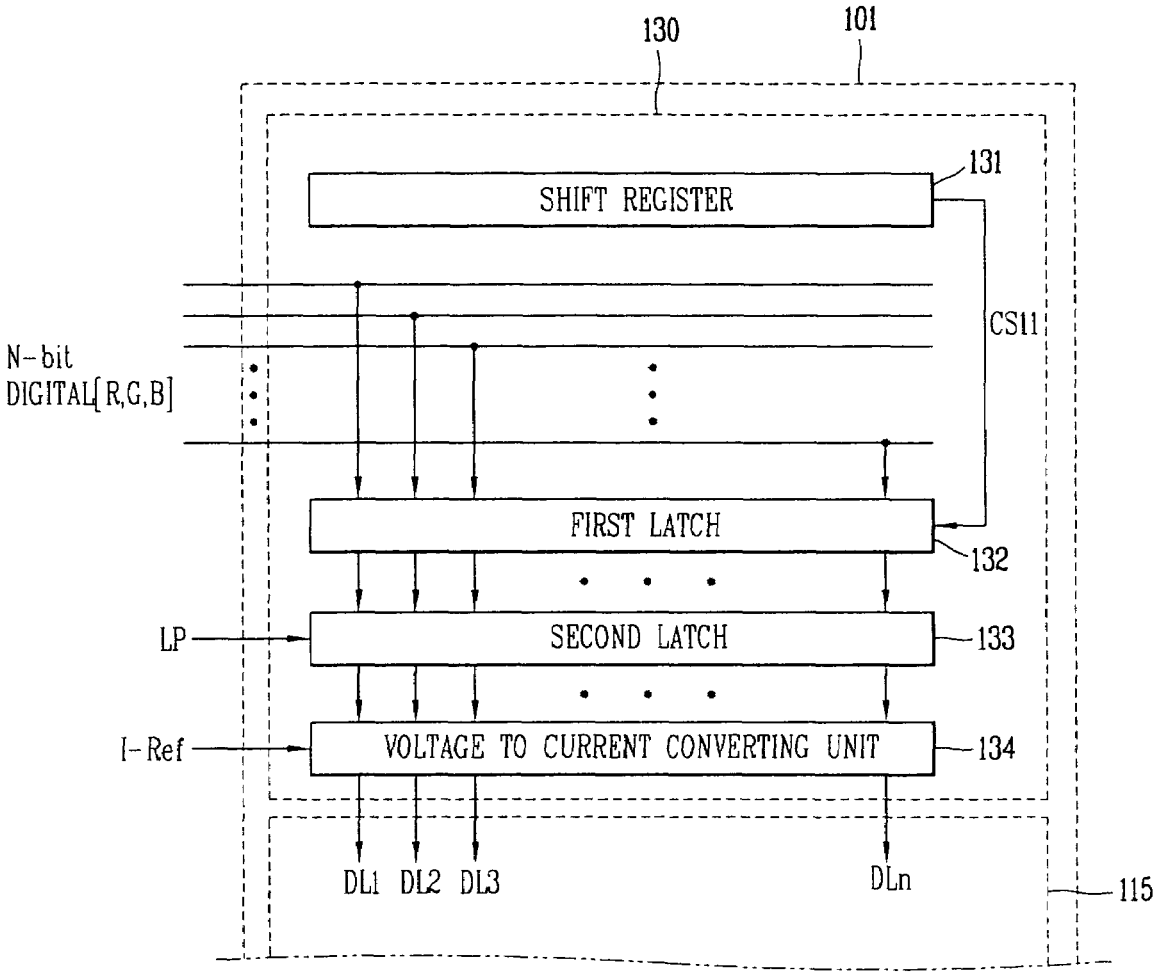
FIG. 5 is an exemplary view showing an inner block configuration of a data driving unit for supplying current values according to sizes of picture signals to data lines in FIG. 4.

FIG. 5 is an exemplary view showing an inner block configuration of the data driving unit 130 which supplies current values according to the sizes of the picture signals of the data line DL.

As shown in FIG. 5, the data driving unit 130 includes a first latch 132 to which is applied a control signal CS11 of a shift register 131 and which sequentially samples N-bit digital picture signals DIGITAL [R, G, B] and stores the picture signals DIGITAL [R, G, B]. A second latch 133 is applied the picture signals DIGITAL [R, G, B] sampled in the first latch 132 and transmits the picture signals DIGITAL [R, G, B] simultaneously by a line pass signal LP. A voltage to current converting unit 134 distributes an outer reference current I-Ref into N paths using a current mirror method according to the picture signals DIGITAL [R, G, B] applied from the second latch 133 and supplies the current to the data line DL of the picture display unit 115.

That is, the first latch 132 sequentially samples and stores the picture signals DIGITAL [R, G, B] having voltage values by the control signal CS11 of the shift register 131. The second latch 133 supplies the picture signals DIGITAL [R, G, B] stored in the first latch 132 to the voltage to current converting unit 134 by the line pass signal LP.

The voltage to current converting unit 134 distributes the outer reference current I-Ref into N paths using the current mirror method by the picture signals DIGITAL [R, G, B] applied from the second latch 133, and supplies the currents to the data line DL of the picture display unit 115.

The voltage to current converting unit 134 according to the present invention can be formed using a poly-crystalline silicon TFT as the reference current I-Ref is distributed using the current mirror method. Therefore, the voltage to current converting unit 134 can be formed on the insulating substrate 101 of the OELD panel 140 with other components of the data driving unit 130, and thereby, an additional process for attaching the data driving unit 130 on the insulating substrate 101 using the tape carrier package method is not required and the fabrication of the OELD can be simplified.

Figure 6:
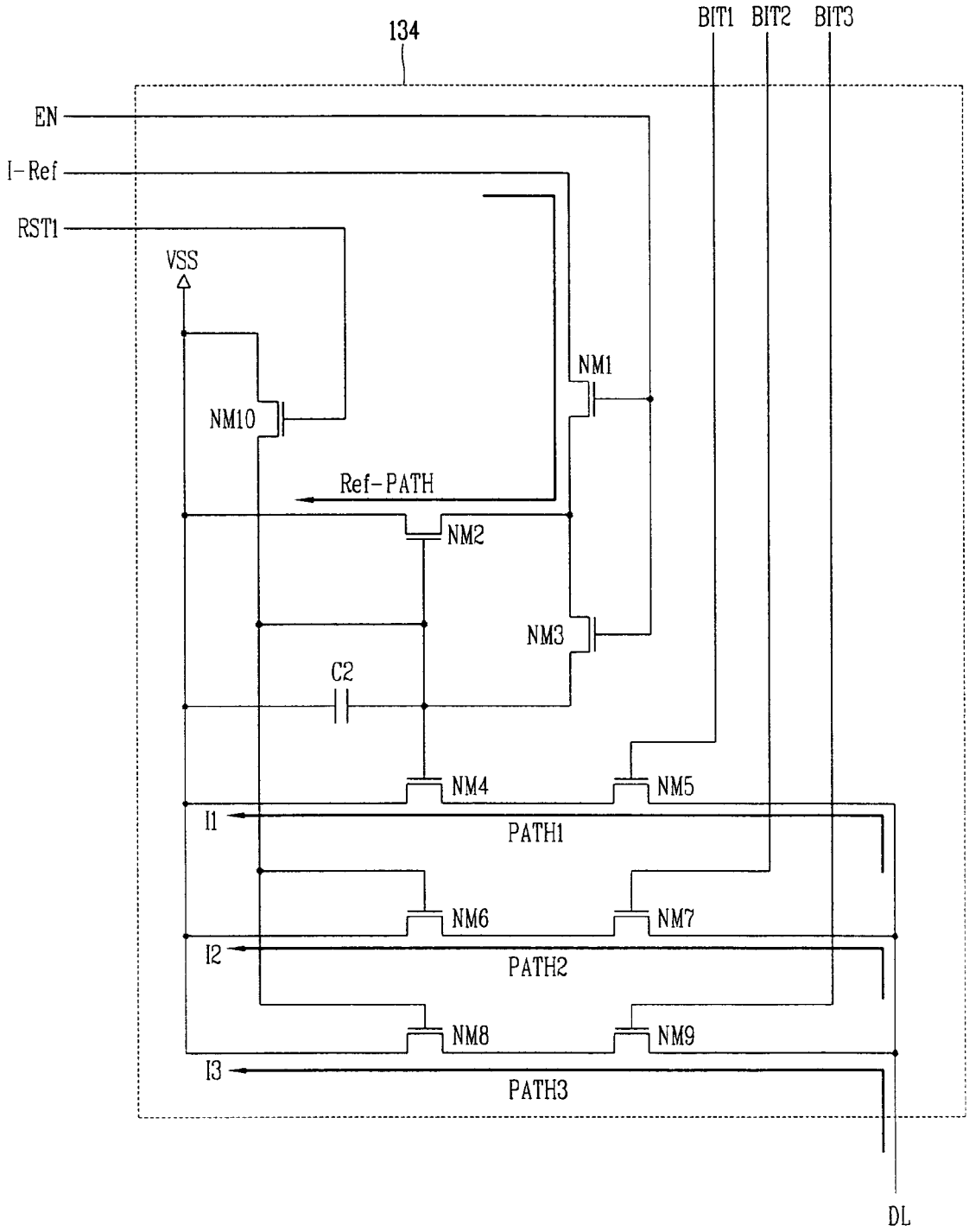
FIG. 6 is an exemplary view showing a first embodiment of circuit configuration of voltage to current converting unit according to the present invention in case that light is illuminated according to 8 gray levels on unit pixel by applying 3-bit digital picture signal from a second latch in FIG. 5.

FIG. 6 is an exemplary view showing a first embodiment of circuit configuration of the voltage to current converting unit 134 according to the present invention when the light is radiated from the unit pixel 10 according to 8 gray levels after applying the 3-bit digital picture signals from the second latch 133.

As shown in FIG. 6, the voltage to current converting unit 134 includes a first NMOS transistor NM1 for controlling the flow of the reference current I-Ref applied to the source electrode by an enable signal (EN) which is applied to the gate electrode. A second NMOS transistor NM2 for forming a reference path (Ref-PATH), on which the reference current flows, by being connected between a drain electrode of the first NMOS transistor and ground (VSS) when the first NMOS transistor NM1 is turned on. A third NMOS transistor NM3 connected between the drain electrode of the first NMOS transistor NM1 and the gate electrode of the second NMOS transistor NM2 to control the flow of the reference current I-Ref by the enable signal (EN) applied to the gate electrode. A second capacitor C2 connected between the drain electrode of the third NMOS transistor NM3 and ground (VSS) to charge the reference current I-Ref when the enable signal (EN) is applied. A fourth NMOS transistor NM4 of which the gate electrode is commonly connected with the gate electrode of the second NMOS transistor NM2 and the source electrode is connected to ground (VSS). A fifth NMOS transistor NM5 connected between the drain electrode of the fourth NMOS transistor NM4 and the data line DL and switching controlled by a first bit picture signal BIT1 applied to the gate electrode from the second latch 133 to form a first path PATH1 on which first current I1 flows. A sixth NMOS transistor NM6 of which the gate electrode is commonly connected with the gate electrode of the second NMOS transistor NM2 and the source electrode is connected to ground (VSS). A seventh NMOS transistor connected between the drain electrode of the fifth NMOS transistor NM5 and the data line DL and switching controlled by a second bit picture signal BIT2 applied to the gate electrode from the second latch 133 to form a second path PATH2 on which second current I1 flows. An eighth NMOS transistor NM8 of which the gate electrode is commonly connected with the gate electrode of the second NMOS transistor NM2 and the source electrode is connected to ground (VSS). A ninth NMOS transistor NM9 connected between the drain electrode of the eighth NMOS transistor NM8 and the data line DL and switching controlled by a third bit picture signal BIT3 applied to the gate electrode from the second latch 133 to form a third path PATH3 on which third current 13 flows. A tenth NMOS transistor NM10 connected between the commonly connected gate electrodes of the second NMOS transistor NM2 and of the fourth NMOS transistor NM4 and ground (VSS) for resetting the gate electrodes of the second NMOS transistor NM2, the fourth NMOS transistor NM4, the sixth NMOS transistor NM6 and of the eighth NMOS transistor NM8 to ground potential by a reset signal RSTl applied to the gate electrode.

The operation of the voltage to current converting unit 134 constructed as above is described in more detail as follows.

First, when the enable signal EN is applied to the gate electrodes of the first and third NMOS transistors NM1 and NM3 as a high voltage, the first to third NMOS transistors NM1 to NM3 are turned on and the reference current I-Ref flows through the reference path Ref-PATH which continues to the first and second NMOS transistors NM1 and NM2 and ground (VSS).

The gate electrode of the second NMOS transistor NM2 is commonly connected to the gate electrodes of the fourth, sixth and eighth NMOS transistors NM4, NM6 and NM8. Therefore, the fourth, sixth and eighth NMOS transistors NM4, NM6 and NM8 are also turned on and first to third paths PATH1 to PATH3 continue to the data line DL. The fourth, sixth and eighth NMOS transistors NM4, NM6 and NM8, and ground (VSS) are respectively formed in parallel.

The first to third paths PATH1 to PATH3 are conducted and blocked by first to third bit picture signals BIT1 to BIT3 applied to the gate electrodes of the fifth, seventh and ninth NMOS transistors NM5, NM7 and NM9 from the second latch 133.

That is, the first to third bit picture signals BIT1 to BIT3 have 8 logical combinations of '000'to '111', and accordingly, the fifth, seventh and ninth NMOS transistors NM5, NM7 and NM9 are turned on or turned off to control the flow of the first to third currents I1 to I3 flowing through the first to third paths PATH1 to PATH3.

The specific circumstances of the logical combinations of '000'to '111' will be described in more detail as follows. Herein, it is assumed that the first bit picture signal BIT1 is the least significant bit (LSB) and the third bit picture signal BIT3 is the most significant bit (MSB).

To begin with, when the first to third bit picture signals BIT1 to BIT3 have a logical combination of '000', the fifth, seventh and ninth NMOS transistors NM5, NM7 and NM9 are turned off, and therefore, the first to third currents I1 to I3 do not flow through the first to third paths PATH1 to PATH3.

Therefore, as described above referring to FIG. 4, the current does not flow on the electroluminescence device 111 of the unit pixel 110, and thereby, light is not radiated from the electroluminescence device 111 and a minimum gray level is displayed.

In addition, when the first to third bit picture signals BIT1 to BIT3 have a logical combination of '001', the fifth NMOS transistor NM5 is turned on and the seventh and ninth NMOS transistors NM7 and NM9 are turned off, and therefore, the first current I1 flows through the first path PATH1 and the second and third currents I1 and I3 do not flow through the second and third paths PATH2 and PATH3.

The first current I1 flowing through the first path PATH1 has the same current value as that of the reference current I-Ref flowing through the reference path Ref-PATH according to the current mirror principle when the second NMOS transistor NM2 and the fourth NMOS transistor have same channel width/length ratios.

However, the voltage to current converting unit 134 according to the first embodiment of the present invention forms the channel width/length ratio of the second NMOS transistor NM2 to be about 7 times larger than that of the fourth NMOS transistor NM4. Therefore, it is desirable that the first current I1 flowing through the first path is about 1 mA when the reference current I-Ref flowing through the reference path Ref-PATH is about 7 mA.

Therefore, when a current of about 1 mA flows on the data line DL of the picture display unit 115, light of gray level according to the '001' combination of first to third bit picture signals BIT1 to BIT3 is radiated from the electroluminescence device 111 of FIG. 4.

In addition, when the first to third picture signals BIT1 to BIT3 have a logical combination of '010', the seventh NMOS transistor NM7 is turned on and the fifth and ninth NMOS transistors NM5 and NM9 are turned off. Therefore, the second current I1 flows through the second path PATH2 and the first and third currents I1 and I3 do not flow through the first and third paths PATH1 and PATH3.

The second current I1 flowing through the second path PATH2 has the same current value as that of the reference current I-Ref flowing through the reference path Ref-PATH according to the current mirror principle when the second NMOS transistor NM2 and the sixth NMOS transistor NM6 have the same channel width/length ratios as described above.

However, in the voltage to current converting unit 134 according to the first embodiment of the present invention, the ratio of channel width/length of the sixth NMOS transistor NM6 is formed to be twice as large as that of the fourth NMOS transistor NM4. Therefore, it is desirable that the second current I1 flowing through the second path is about 2 mA when the reference I-Ref flowing through the reference path Ref-PATH is about 7 mA.

When a current of about 2 mA flows on the data line DL of the picture display unit 115, light of a gray level according to the combination of '010' of the first to third bit picture signals BIT1 to BIT3 is radiated from the electroluminescence device 111 of FIG. 4.

In addition, when the first to third bit picture signals BIT1 to BIT3 have a logical combination of '011', the fifth and seventh NMOS transistors NM5 and NM7 are turned on and the ninth NMOS transistor NM9 is turned off. Therefore, the first and second currents I1 and I2 flow through the first and second paths PATH1 and PATH2 and the third current I3 does not flow through the third path PATH3.

As described above, a current of about 1 mA flows through the first path PATH1 and a current of about 2 mA flows through the second path PATH2. Therefore, a current of about 3 mA flows through the data line DL of the picture display unit 115. A light of a gray level according to the '011' combination of the first through third bit picture signals BIT1 to BIT3 is radiated from the electroluminescence device 111 of FIG. 4.

In addition, when the first to third bit picture signals BIT1 to BIT3 have a logical combination of '100', the ninth NMOS transistor NM9 is turned on and the fifth and seventh NMOS transistors NM5 and NM7 are turned off. Therefore, the third current I3 flows through the third path PATH3 and the first and second currents I1 and I2 do not flow through the first and second paths PATH1 and PATH2.

The third current I3 flowing through the third path PATH3 has the same current value as that of the reference current I-Ref flowing through the reference path Ref-PATH according to the current mirror principle, when the second NMOS transistor NM2 and the eighth NMOS transistor NM8 have same channel width/length ratios as described above.

However, in the voltage to current converting unit 134 according to the first embodiment of the present invention, the ratio of the channel width/length of the eighth NMOS transistor NM8 is formed to be four times as large as that of the fourth NMOS transistor NM4. Therefore, it is desirable that the third current I3 flowing through the third path PATH3 is about 4 mA when the reference current I-Ref flowing through the reference path Ref-PATH is about 7 mA.

When a current of about 4 mA flows on the data line DL of the picture display unit 115, light of a gray level according to the '100' combination of the first to third bit picture signals BIT1 to BIT3 is radiated from the electroluminescence device 111 of FIG. 4.

In addition, when the first to third bit picture signals BIT1 to BIT3 have a logical combination of '101', the fifth and ninth NMOS transistors NM5 and NM9 are turned on and the seventh NMOS transistor NM7 is turned off. Therefore, the first and third currents I1 and I3 flow through the first and third paths PATH1 and PATH3 and the second current I2 does not flow through the second path PATH2.

As described above, a current of about 1 mA flows through the first path PATH1, and the current of about 3 mA flows through the third path PATH3. Therefore, a current about 5 mA flows through the data line DL of the picture display unit 115 and light of a gray level according to the '101' combination of the first to third bit picture signals BIT1 to BIT3 is radiated from the electroluminescence device 111 of FIG. 4.

In addition, when the first to third bit picture signals BIT1 to BIT3 have a logical combination '110', the seventh and ninth NMOS transistors NM7 and NM9 are turned on and the fifth NMOS transistor NM5 is turned off. Therefore, the second and third currents I2 and I3 flow through the second and third paths PATH2 and PATH3 and the first current does not flow through the first path PATH1.

As described above, a current of about 2 mA flows through the second path PATH2 and the current of about 4 mA flows through the third path PATH3. Therefore, a current of about 6 mA flows through the data line DL of the picture display unit 115, and light of a gray level according to the '110' combination of the first to third bit picture signals BIT1 to BIT3 is radiated from the electroluminescence device 111 of FIG. 4.

In addition, when the first to third bit picture signals BIT1 to BIT3 have a logical combination of '111', the fifth, seventh and ninth NMOS transistors NM5, NM7 and NM9 are turned on, and therefore, the first to third currents I1 to I3 flow through the first to third paths PATH1 to PATH3.

As described above, currents of about 1 mA, 2 mA and 4 mA flow through the first to third paths PATH1 to PATH3. Therefore, a current of about 7 mA flows on the data line DL of the picture display unit 115, and light of the highest gray level according to the combination of '111' of the first to third bit picture signals BIT1 to BIT3 is radiated from the electroluminescence device 111 of FIG. 4.

On the other hand, when the enable signal (EN) is applied as a high voltage and the third NMOS transistor NM3 is turned on, the reference current I-Ref is charged in the second capacitor C2 through the third NMOS transistor NM3. Accordingly, the reference current I-Ref flowing through the reference path Ref-PATH can be maintained after the enable signal (EN) is becomes a low voltage. Therefore, the reference current I-Ref supplied from outer side is charged in the second capacitor C2 repeatedly in the section in which the enable signal (EN) is applied as a high voltage. The charging time is sufficient when the number of current sources which supplies the reference current I-Ref is increased. The power consumption can be reduced greatly.

Also, when the reference current I-Ref is supplied to red, green and blue color pixels independently in order to realize a color picture, the reference current I-Ref level can be controlled independently.

On the other hand, the reset signal (RST) applied to the gate electrode of the tenth NMOS transistor NM10 resets the gate electrodes of the second, fourth, sixth and eighth NMOS transistors NM2, NM4, NM6 and NM8 into ground (VSS) potential regularly.

As described above, the voltage to current converting unit 134 according to the first embodiment of the present invention supplies the different current values for the logical combinations of the first to third bit picture signals BIT1 to BIT3 to the data line DL of the picture display unit 115 with the combinations of the first to third paths PATH1 to PATH3 through the fourth, sixth and eighth NMOS transistors NM4, NM6 and NM8 which are formed to have different ratios of channel width/length from that of the second NMOS transistor NM2.

However, when the first embodiment of the present invention is applied, different current values for the first to third bit picture signals BIT1 to BIT3 can be supplied to the data line DL of the picture display unit 115 in 7 paths through the 7 NMOS transistors BIT1 to BIT3 having the ratios of channel width/length which are 7 times less than that of the second NMOS transistor.

Also, electric switching devices of 3-terminals which are able to control switching of electric signal by the control signal can be applied to the first, third, fifth, seventh, ninth and tenth NMOS transistors NM1, NM3, NM5, NM7, NM9 and NM10 having gate electrodes to which the enable signal (EN), the first to third bit picture signals BIT1 to BIT3 and the reset signal (RST) are applied.

As described above, the driving circuit of the flat panel display according to the present invention realizes the voltage to current converting unit as a poly-crystalline TFT and distributes the reference current using the current mirror method, and thereby, the voltage to current converting unit can be built in the display panel with other components of the data driving unit. Therefore, an additional process for attaching the data driving unit on the display panel in the tape carrier package method is not required, and the fabrication of the OELD can be simplified. Therefore, cost for fabricating the flat panel display can be reduced.

Also, the present invention adopts the current driving method, and therefore, degradation of the picture quality due to the property unevenness of the poly-crystalline silicon TFT can be prevented and the yield can be improved.

In addition, since the reference current supplied from the outer side is charged repeatedly, charging time is sufficient when a number of the current sources supply the reference current, and the power consumption can be reduced greatly.

It will be apparent to those skilled in the art that various modifications and variations can be made in the driving circuit for flat panel display of the present invention without departing from the spirit or scope of the invention. Thus, it is intended that the present invention covers the modifications and variations of this invention provided they come within the scope of the appended claims and their equivalents.

What is claimed is:

1. A driving circuit for a flat panel display, the flat panel display including the driving circuit and a display panel being driven by the driving circuit to display an image, the driving circuit comprising:

a latch unit to which a control signal is applied from a shift register to sample at least one digital picture signal and to store the digital picture signal, the latch unit simultaneously outputting the sampled picture signal by a line pass signal; and a voltage to current converting unit supplying current of a plurality of levels to a data line of the display panel according to logical combinations of the sampled picture signal from the latch unit, using a current mirror method, wherein the voltage to current converting unit includes a plurality of poly-crystalline switching units formed on the display panel.

2. The circuit of claim 1, wherein the latch unit comprises:

a first latch unit being applied the control signal from the shift register to sample and store the digital picture signal having a plurality of bit numbers; and a second latch unit outputting the digital picture signal sampled in the first latch unit simultaneously according to the line pass signal.

3. The circuit of claim 1, wherein the shift register, the latch unit and the voltage to current converting unit are formed in the display panel.

4. The circuit of claim 1, wherein the display panel is an organic electroluminescence display panel.

5. The circuit of claim 1, wherein the voltage to current converting unit includes a current mirror structure with a plurality of current paths.

6. The circuit of claim 5, wherein the plurality of current paths are formed to be the same as bit numbers of the sampled picture signal.

7. The circuit of claim 5, wherein the plurality of current paths are formed to be the same as a number of logical combinations of bits of the sampled picture signal.

8. The circuit of claim 5, wherein the current mirror structure receives a reference current and supplies the current of the plurality of levels selectively from at least one of the plurality of current paths according to the logical combinations of the sampled picture signal.

9. A driving circuit for a flat panel display, the circuit comprising:

a latch unit to which a control signal is applied from a shift register to sample at least one digital picture signal and to store the digital picture signal, the latch unit simultaneously outputting the sampled picture signal by a line pass signal; and a voltage to current converting unit supplying current of a plurality of levels to a data line of the display panel according to logical combinations of the sampled picture signal from the latch unit, using a current mirror method, wherein the voltage to current converting unit comprises:

a first switching unit for controlling a flow of a reference current by an enable signal;

a second switching unit connected to the first switching unit for controlling the flow of the reference current by the enable signal; and a plurality of switching units for controlling switching of a plurality of current paths by being applied the sampled picture signal having a plurality of bit numbers independently.

10. The circuit of claim 9, wherein the first switching unit, second switching unit and the plurality of switching units comprise NMOS transistors.

11. The circuit of claim 10, wherein each NMOS transistor is a poly-crystalline silicon TFT.

12. The circuit of claim 9 further comprising a capacitor connected between the second switching unit and ground for charging the reference current.

13. The circuit of claim 9, wherein the voltage to current converting unit further includes:

a first NMOS transistor for forming a reference path on which the reference current flows between the first switching unit and ground by being applied the reference current on a gate electrode thereof; and a plurality of NMOS transistors not including the first NMOS transistor for forming the plurality of current paths in a parallel direction between the data line and the ground of the display panel according to the sampled picture signal having a plurality of bit numbers by being applied the reference current on respective gate electrodes thereof.

14. The circuit of claim 13, wherein the first NMOS transistor and the plurality of NMOS transistors are poly-crystalline silicon thin film transistors (TFTs).

15. The circuit of claim 13, wherein the plurality of NMOS transistors includes an NMOS transistor for resetting the gate electrodes of the first NMOS transistor which forms the reference path and of the plurality of NMOS transistors which form the plurality of current paths in a parallel direction to ground potential by a reset signal.

16. The circuit of claim 13, wherein the first NMOS transistor is formed to have a ratio of channel width/length differently from those of the plurality of NMOS transistors.

17. The circuit of claim 16, wherein the ratios of channel widths/lengths of the plural NMOS transistors are made to be different from those of each other.

18. The circuit of claim 16, wherein the ratios of channel widths/lengths of the plurality NMOS transistors are made to be the same as each other.

* * * * *